US006245002B1

(12) United States Patent
Beliakov

(10) Patent No.: US 6,245,002 B1
(45) Date of Patent: Jun. 12, 2001

(54) SIMPLE EXERCISING APPARATUS FOR MUSCULAR DEVELOPMENT IN ATHLETES

(76) Inventor: Evgeni Beliakov, 11707 High View, Silver Spring, MD (US) 20902

( * ) Notice: Subject to any disclaimer, the term of this patent is extended or adjusted under 35 U.S.C. 154(b) by 0 days.

(21) Appl. No.: 09/192,302

(22) Filed: Nov. 17, 1998

(51) Int. Cl.[7] ..... A63B 69/00
(52) U.S. Cl. ..... 482/148; 482/903
(58) Field of Search ..... 482/148, 83, 86, 482/903, 4, 5, 84, 7

(56) References Cited

U.S. PATENT DOCUMENTS

| | | | | |
|---|---|---|---|---|
| 3,398,953 | * | 8/1968 | Thompson | 482/83 |
| 3,973,772 | * | 8/1976 | Milliken | 272/76 |
| 4,749,189 | | 6/1988 | Frank | 272/136 |
| 5,176,599 | | 1/1993 | Beliakov | 482/91 |
| 5,573,486 | | 11/1996 | Beliakov | 482/120 |
| 5,665,035 | * | 9/1997 | Tumminia | 482/83 |

* cited by examiner

*Primary Examiner*—Glenn E. Richmon

(74) *Attorney, Agent, or Firm*—Breiner & Breiner

(57) ABSTRACT

This invention provides an inexpensive athletic exercising system for development of muscles of the athlete to increase the velocity and strength of movement of a body member away from an initial position toward a further position employing in a preferred embodiment of the invention a set of two magnetic members for magnetic retention together with a predetermined magnetic force. The first magnetic member is affixed to an athletic vehicle, such as a tennis racquet, ball bat or hockey stick, to be manipulated by said athlete. The second magnetic member is positioned at a restrained position from which an athletic stroke is initiated for magnetic retention together with the first magnetic member. This system permits an athlete to develop strength and speed in muscular reaction over an athletic stroke by manual manipulation of the athletic vehicle to overcome the predetermined magnetic force while permitting a substantially unimpeded follow through stroke after the initial magnetic force is overcome. The invention may be embodied in a tackling dummy arrangement or a delivery and return of a boxing stroke arrangement by employment of a spring receiving the impact of a broken away magnetic member which forcefully returns the punching arm at the apex of the boxing stroke.

4 Claims, 4 Drawing Sheets

SIMPLE EXERCISING APPARATUS FOR MUSCULAR DEVELOPMENT IN ATHLETES

FIELD OF THE INVENTION

This invention relates to specialized exercising apparatus and methods for muscular development in athletes to increase the speed and strength of an athlete's stroke when departing from an initial position, and more particularly it relates to such devices employing resistant forces at threshold levels to be overcome by an athlete's stroke away from the initial position.

BACKGROUND ART

From my U.S. Pat. No. 5,176,599, Jan. 5, 1993 it is known that magnetically attracted members may provide threshold forces to condition the muscles of boxers for strengthening and speeding up the delivery of boxing punches. However, complex and expensive equipment is required, which is restricted to the boxing sports. Furthermore operation of such machines required tethers that interfered with and distorted normal follow through strokes.

It is seen from U.S. Pat. No. 4,749,189, Jun. 7, 1988 by S. M. Frank for Exercise Machine for Hockey Players, that the same problem of interference with and distortion of a follow through stroke of a hockey stick was imposed.

Accordingly it is an objective of this invention to improve the state of prior art methods and apparatus for muscular development of an athlete for delivering a faster more powerful stroke.

More explicitly it is an objective to both simplify the nature and lower the cost of exercising machines, while at the same time unexpectedly improving the functional performance of exercising machines for athletes.

Other objects, features and advantages will be found throughout the following description, drawings and claims.

DISCLOSURE OF THE INVENTION

This invention provides an inexpensive athletic exercising system for development of muscles of the athlete to increase the velocity and strength of movement of a body member stroke away from an initial position toward a further position, typically an impact point. A set of two members, typically magnetic members hereinafter described in more detail in a preferred embodiment, are held together in a mated position until separated by overcoming a predetermined magnetic separating force. Electro-magnetic members permit the separating force to be variably controlled to challenge the athlete as the muscular actions improve. The athlete by manual exertion separates the two magnetic members, thus exercising and developing the stroking muscles for stronger and faster movement away from a starting point.

Thus, greater athletic capabilities are developed for impacting a ball, a boxer's body, or a hockey puck, etc. Similarly non-impact skills may be developed, such as a faster start to first base, or foot races, or a more powerful accelerated sprint in a football play using the teachings of this invention.

While alternative held-together-and-separable-under-tension devices may be substituted for two magnetically attracted members, such as adhesively attached, frictionally bonded, or integrally connected members formed in one piece that can be catastrophically broken apart, nondestructive and thus reusable magnets are the preferred embodiment as discussed in detail hereinafter for illustrating the nature and spirit of the invention with reference to FIG. 9.

A first magnetic member is affixed to a movable athletic implement, such as a tennis racquet, ball bat, hockey stick, boxing glove, shoe, etc. to be manipulated by said athlete through an athletic stroke. The second magnetic member is restrained at a fixed position. The two magnetic members comprise at least one permanent or electro-magnet and the two members are arranged to mate and exhibit a predetermined separation force to separate them. The first magnetic member is preferably unrestrained by tethering or a mated position. Thus, it breaks away for freely moving with an athlete's body member in a follow through athletic stroke when the magnetic retention bond with the first magnetic member is broken. A significant advantage is that magnetic members may be light weight and small in size so that they do not tend to interfere with normal stroke paths or follow through action of the athlete after the initial magnetic bonding force is broken.

This system permits an athlete to develop strength and speed in muscular reaction for critical athletic strokes by manual manipulation of the athletic implement by an athlete's body member to overcome the predetermined initial threshold bonding force between the magnetic members. This system following the unbonding of the magnetic members, permits unrestrained movement of the athlete's body member in a follow through action, thereby avoiding abnormal restraints generally imposed by prior art exercising devices such as heretofore discussed requiring tethers or harnesses to be attached to athletic implements such as a boxing glove or a hockey stick.

Other features and advantages of the invention will be found throughout the following description, claims and accompanying drawings.

BRIEF DESCRIPTION OF THE DRAWINGS

In the accompanying drawings, wherein like reference characters throughout the various views designate related elements for convenience in comparison.

THE PREFERRED EMBODIMENTS

Figure 1:
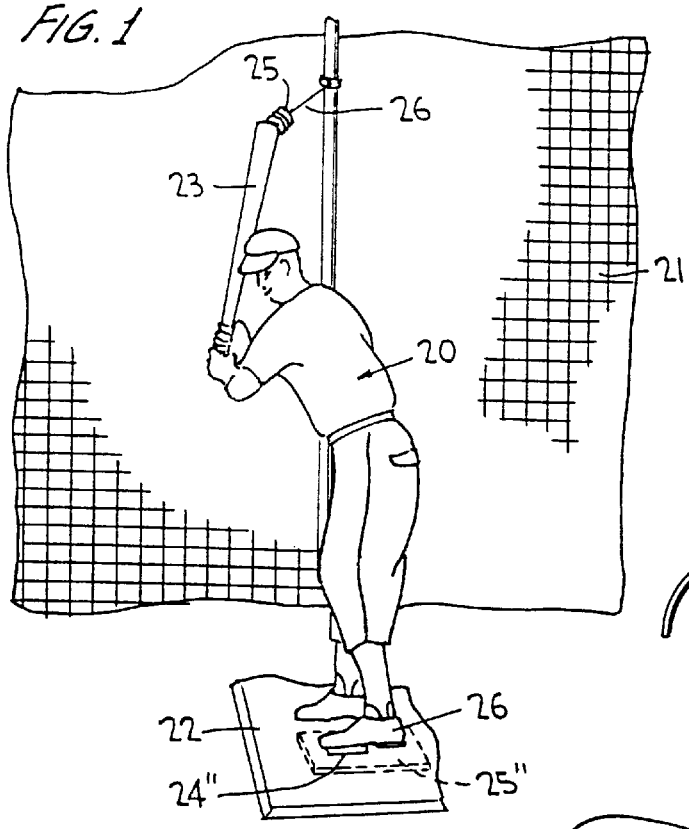
FIG. 1 is a sketch of a baseball player in a batting cage training for the development of muscular strength and speed of reaction in both batting practice and getting off to a high velocity start toward first base in accordance with the teachings of this invention.
Figure 2:
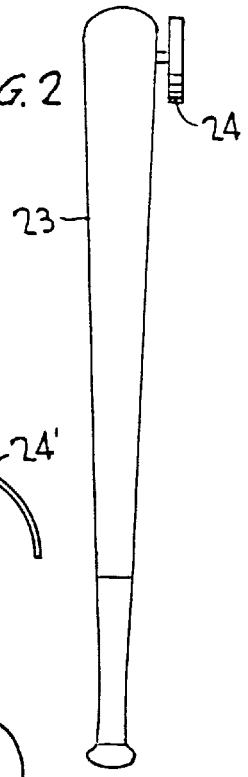
FIG. 2 is sketch of a baseball bat that may be used in a free untethered followthrough swing movement during the muscle training phase as featured by this invention.
Figure 3:
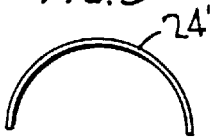
FIG. 3 is a end view sketch of a sheet magnet that may be used to conform to the surface configurations of athletic instruments such as bat of FIG. 2.

In FIG. 1 the improved training system afforded by this invention for developing superior athletic muscular strength and speed is illustrated by a baseball player 20 standing in a batting cage 21 in a designated batter's box 22. The bat 23, (FIG. 2) has mounted thereon a magnet, schematically shown at 24, but which may take the form of a thin light magnetic sheet 24' (FIG. 3) which conforms to the outer surface of bat 23, and does not significantly disturb the balance, the surface configuration, or the weight of the bat.

For hitting purposes, not only must a bat be swung quickly for hitting fast ball pitches, but the batter 20 needs enough time to see the pitch and determine strategy. Thus, it is important to accelerate the bat swing quickly from its starting position and put as much energy as possible into the swing for propelling the baseball. To tune up the athlete's muscles for this, the two magnetic members 24 and 25 are magnetically attached in FIG. 1 with a predetermined bonding force that may be overcome when the athlete's arms move away with sufficient force to overcome the bonding force. Thus, the arm and shoulder muscles by practice in displacing the two attached members 24, 25 become conditioned to supply more rapid acceleration and power into the swing, thereby giving the batter an instant larger to view the incoming pitch.

The second attachment member, namely magnetic member 25 is affixed by a post or tether 26 to the batting cage 21 in a fixed position adjustably placed to suit the stance of the batter. Thus, when the bond between the attachment members 24, 25 is broken, the bat is free to swing through a normal swing with appropriate follow through stroking action, as contrasted from the tethered relationship of the mechanisms in the aforesaid background patents which would restrict and make unnatural a follow through swing. This unrestricted follow through stroke, of course, is pertinent in batting practice and in other kinds of athlete's follow through strokes, such as by using a tennis racquet instead of a bat.

Another arrangement could be made for improving muscular reaction in a flick of the wrist at the time of impact of the ball by rearranging the fixed attachment member location and practicing without taking a full swing. Also the attachment members need not be magnets, although they have advantages of non-destructive reusability, the ability to readily change the holding force with spacer shims or the like, and variable electromagnetic forces available at the fixed site. For example, the sheets of FIG. 3 might constitute two mating adhesively bonded plastic sheets, or other frictional holding structure that gives the desired break away action at threshold forces of appropriate magnitude. Also catastrophically broken integral structures to be broken away, such as a fabric or solid member could be used, but are not preferred because of the non-destructive nature of magnetic members.

This break away action, may also be employed for practicing the fastest possible start toward first base after the batter contacts the ball, by way of a magnetic members 24" and 25" respectively affixed to the batting box 22 and the athlete's shoe 26.

In a similar manner the bonding attachment members may be used on a hand ball or tennis racquet, golf club or other athlete's sport implement for appropriate practice to develop better athletic prowess.

Figure 4:
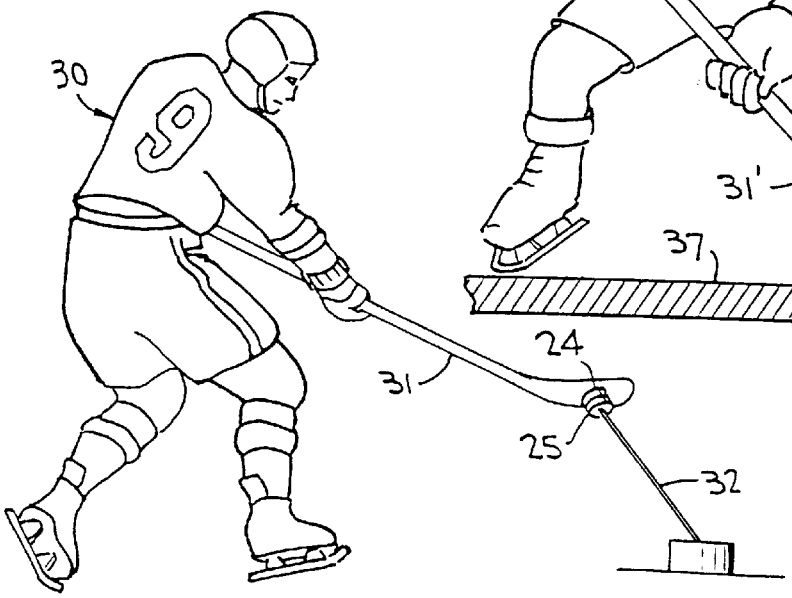
FIG. 4 is a sketch of a hockey player in the act of developing muscular strength, speed and wrist action for initiating a hockey stick stroke.

The hockey player 30 seen in FIG. 4 is handling the hockey stick 31 which is attached to the pedestal 32 by way of the mated and bonded together magnetic members 24, 25. The post or tether 32 may be positioned in location convenient to the athlete for carrying the stick 31 in a ready to shoot the puck position. Thus the player 30 may exercise and develop the muscles used in the necessary wrist and arm snap action for impact of the stick 31 with a puck in the same general manner aforesaid by breaking away the pair of bonded magnetic members 24, 25.

Figure 5:
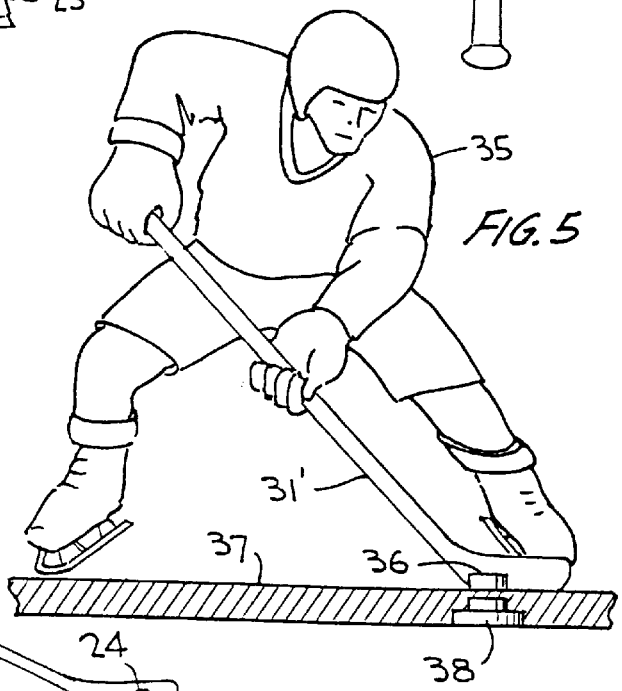
FIG. 5 is a sketch of a hockey player in the act of developing athletic prowess at the moment of impact of the hockey stick with a puck.
Figure 6:
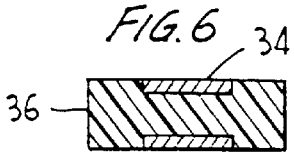
FIG. 6 is a sketch in cross section of a hockey puck embodiment afforded by the invention.

The hockey player 35 in FIG. 5 practicing for an impact of the stick 31', which carries no magnetic member, with the puck 36, also shown in FIG. 6, on the surface of ice 37 in which the magnetic member 38 is embedded. Thus puck 36, which has magnetic members 34 at the upper and lower puck surfaces is held in place on the ice surface by magnetic bonding forces that must be overcome by the impact of the stick 31. The wrist and arm muscles involved in this action are thus challenged by the magnetic bond and developed for better athletic prowess in this particular maneuver.

Figure 7:
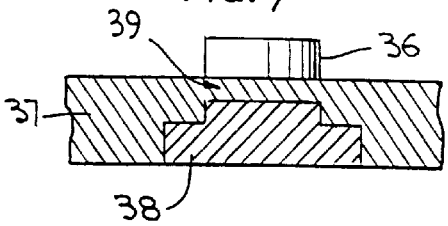
FIG. 7 is a fragmental side view of a hockey puck riding on ice above a magnet embedded in ice, as afforded by an embodiment of the invention.
Figure 8:
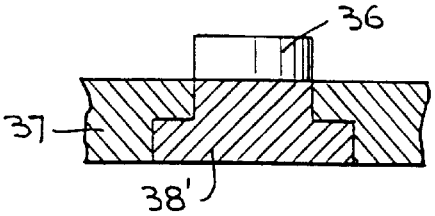
FIG. 8 is a alternative embodiment of a hockey puck riding on ice above a magnet embedded in ice.

The magnetic bonding forces may be varied by the thickness of the ice gap 39 shown in FIG. 7 as produced by heights of the embedded magnetic member 38', as shown in FIGS. 7 and 8 to be nearer to or farther from the puck 36 for corresponding different threshold bonding forces.

Figure 9:
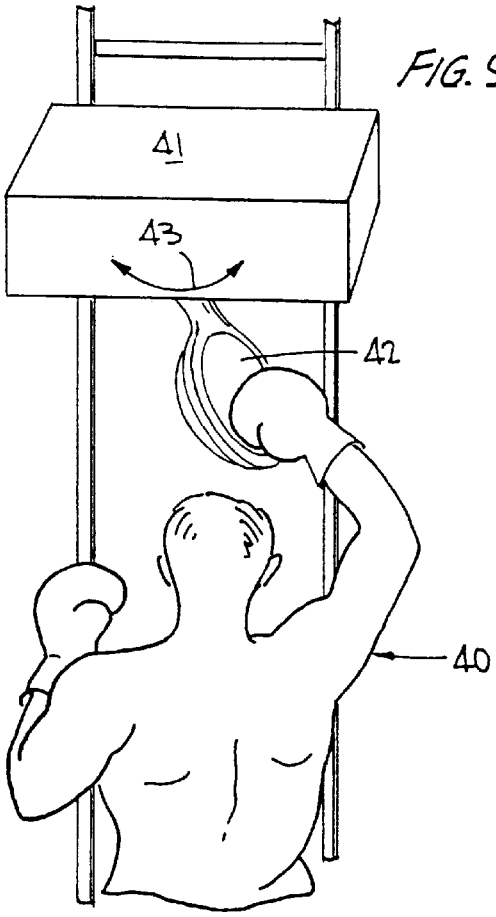
FIG. 9 is a sketch of a boxer engaged in a punching bag type of muscular development afforded by an embodiment of the invention.
Figure 10:
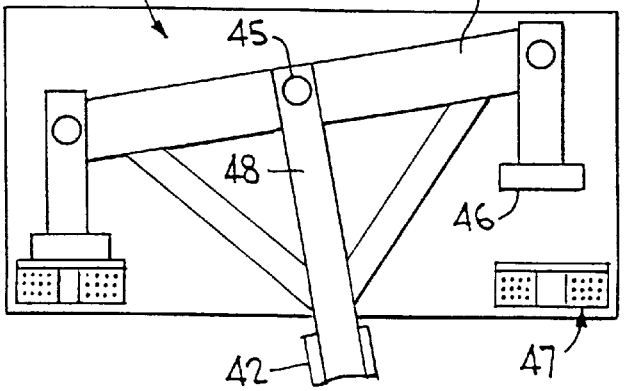
FIG. 10 is a sketch of a mechanism embodiment of the invention providing bi-stable magnetic attraction at two positions of a pivoted rocker arm for providing improved punching bag type of exercise.

For boxers 40, as shown in FIG. 9, punching bag exercises embody the invention by a rocker arm mechanism 41, which swings the two sided punching medium 42 from side to side upon impact of the boxer's glove, as indicated by arrow 43. Operation of the rocker arm mechanism 41 is seen by the sketch of FIG. 10, wherein the rocker arm 44 is pivoted at pivot axis 45 to bistably rest in either of two positions with the magnetic member 46 in mated and bonded position upon the electromagetic member 47 on an appropriate side. The impact receiving member 42 is pivoted back and forth between stable positions by the normally extended arm 48 as propelled by movement of a boxer's glove, respectively alternately the right and left gloves of FIG. 9. It is readily seen that as the strength of the electromagnets 47 is varied, by means not shown, either individually or in unison, the boxer impact strength to overcome the bonding force is varied. Thus, a stronger force may be designated for the right or left arm, if desired, and the impact necessary to dislodge the respective end of the rocker arm from its electromagnet 47 may be increased to develop the boxer's muscles to deliver greater impact forces.

Figure 11:
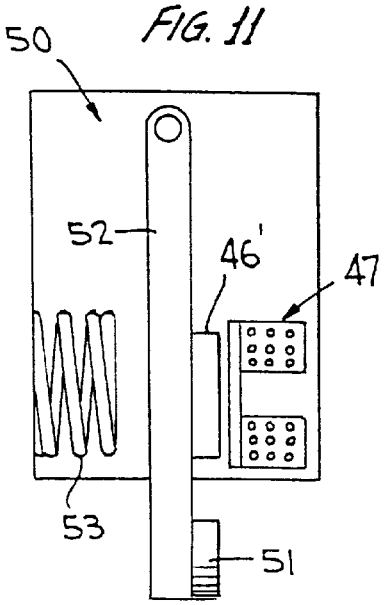
FIG. 11 is a sketch of a further mechanism embodiment of the invention for exercise in a punching bag type of exercise.

The alternative mechanism 50 of FIG. 11 is useful in developing punching rythm in the manner of a punching bag. Thus, when a boxer impacts pad 51 with a glove and breaks the magnetic bonding force, the pivoted lever arm 52 contacts spring 53 for sending the pivot arm 52 back into its magnetically bonded position. In this embodiment, the pivotable member 52 comprises a second degree lever arm carrying the magnetic member 46 in an intermediate position on the lever arm, and the impact pad at a distal end for contact with a boxer's glove to move the lever away from its normally mated position with electromagnet 47 to strike the return spring 53.

Figure 12:
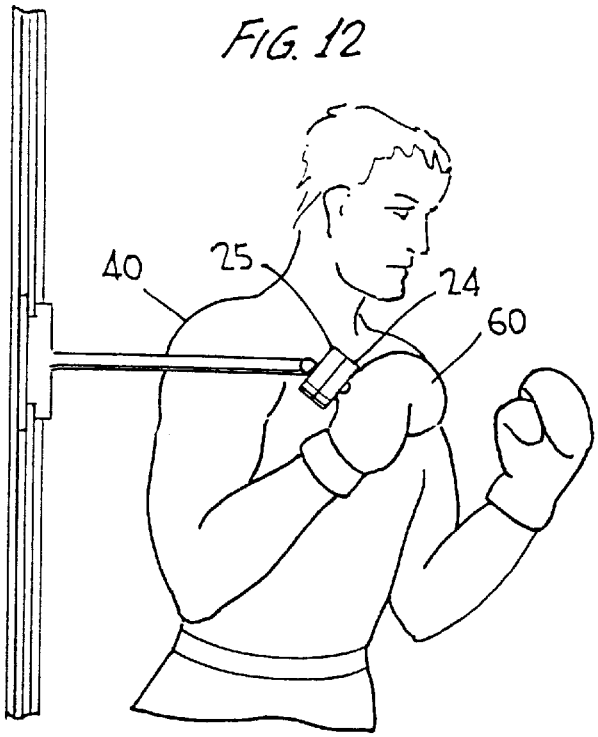
FIG. 12 is a sketch of a boxer in training for developing muscular strength and speed in launching a punch in accordance with the teachings of this invention.

A simpler boxer training system is sketched in FIG. 12, wherein the boxer 40 is developing muscular reaction that will permit a faster more powerful punch. The separable magnetic member 24 is carried on the boxer's glove 60 so that after release from magnetic member 25, the arm is free to make a punch in a normal untethered fashion.

Figure 13:
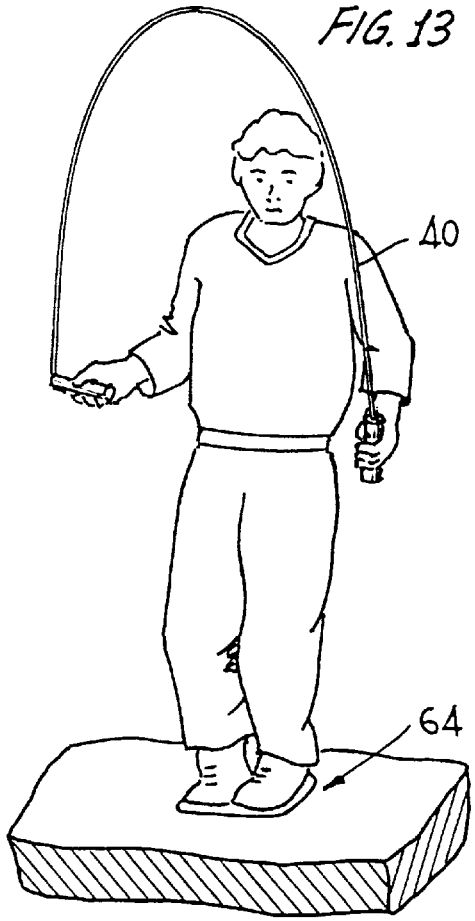
FIG. 13 is a sketch of a boxer in a skip rope exercise illustrated in this embodiment of the invention.
Figure 14:
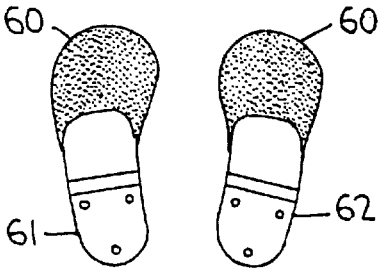
FIGS. 14 and 15 are respective sketches of magnetic member embodiments of the invention for development of muscular strength and speed in skip rope exercises.
Figure 15:
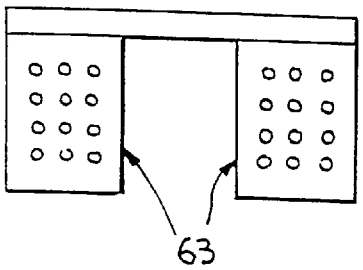

As illustrated in FIGS. 13–15, this invention is useful by a boxer 40 in skip rope training exercises or any athlete who wishes to improve jumping ability. The leg and foot muscles are thus developed for more mobility and agility and a fast jump start by the use of magnetic members 60 on the shoes 61, 62, which rest upon and become bonded to the electromagnet footrest members 63 positioned at the skip-rope site 64.

Figure 16:
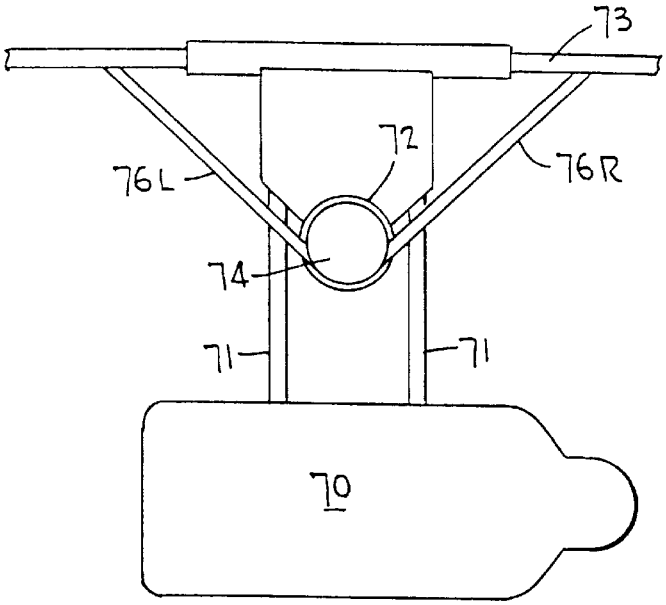
FIGS. 16 and 17 are respectively side and end view sketches of a tackling or blocking dummy embodiment of the invention.
Figure 17:
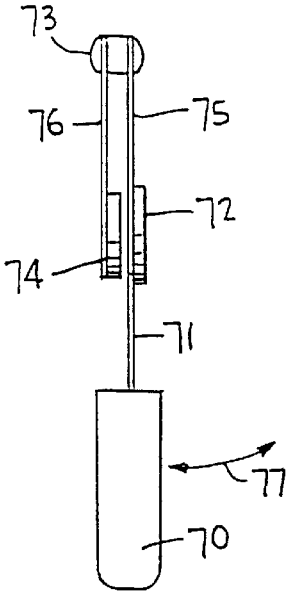

In FIGS. 16 and 17 the exercise machine embodiment of the invention may be commonly termed a tackling or blocking dummy for practice in such games as football and rugby. Accordingly, the cushioned pad dummy 70 is supported on bracing legs 71 which are firmly affixed to post or stanchion 73. Similarly, the magnet 74 is affixed by the framework 76R and 76L to the post 73 as a stationary unit. This magnet 74, which is preferably an electromagnet of variable magnetic strength, and a corresponding magnetic member 72 normally magnetically engaged with the magnet 74 is carried between the legs 71 for positioning the dummy in a stable locked on position, ready for impact by an athlete.

When impacted with enough force to break apart the magnetic members 72, 74 the dummy 70 moves through the arc 77, as a function of a spring biassing member 75, which could comprise either flexible spring steel legs 71 at the anchored end, or other appropriate springing structure. Thus the body 70 is in essence cantilevered to the post 73 or other stable framework member in this embodiment.

This exercise machine has the significant advantage over prior art tackling dummies which do not break away in a less restricted follow through stroke mode of operation in that the athlete is less likely to become injured by an unforgiving solid body of heavy weight.

Figure 18:
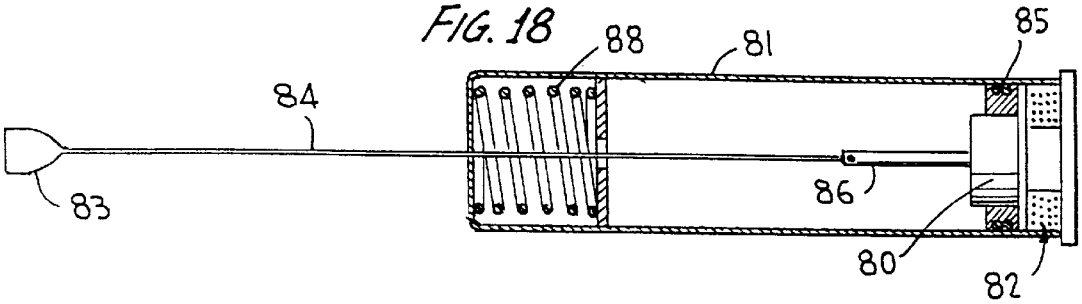
FIG. 18 is a side view of a piston mechanism embodiment of the invention, with casing partly broken away.

In FIG. 18, the exercise machine embodiment comprise a piston-cylinder array 80, 81, with an internal holding electromagnet 82. Thus an athlete may by grasping handle 83 at the end of the cable 84 break the hold of the piston 80 against magnet 82 to effect the advantages hereinbefore set forth. The piston 80 preferably has packing 85 and a partly pneumatically sealed cylinder arrangement to stabilize the movement of the piston after breakaway. The cable is affixed at the inner end to the piston rod 86 along the cylinder axis.

Heretofore the advantages of the breakaway action for conditioning muscles for a fast, energetic punch have been suggested. However, in this embodiment the spring 88 is a further training implement that receives the piston 80, absorbs its energy, storing it for a forceful return of the piston 80 and the handle 83. This happens as the arm is straightened out and conditions the reaction of returning the arm quickly after a delivered punch, whether or not it finds a target. In other words, practice with this embodiment conditions the arm for both delivery of the stroke and concurrent concentration on the return stroke turn around and return stroke acceleration and timing.

Figure 19:
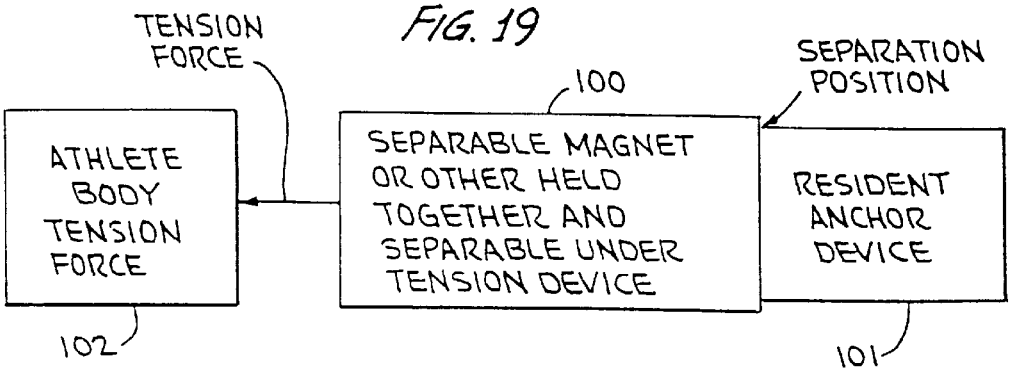
FIG. 19 is a block diagram view of the operating method of the invention in breaking away a separable device from a resident anchor location by an athlete's body tension force.

As seen in FIG. 19, a magnet or other held-together-and-separable-under-tension device 100 may be separated from a resident anchor device 101, at an appropriate separation position by tension for supplied by impact of an athlete body member 102.

It is seen therefore that this invention provides simple and effective methods and apparatus for development of key muscles by athletes for improving the speed and force of critical athletic reactions which incorporate a low cost set of two mating attachment members that break-away as detached members by manual action of an athlete for developing and toning muscles to produce more power and velocity in critical athletic activities.

Therefore having advanced the state of the art, those novel features representative of the spirit and nature of this invention are defined in particularity in the following claims.

What is claimed is:

1. An athletic training system for development of muscles of an athlete to increase velocity and strength of movement of an athlete's body member away from an initial position toward a further position, comprising in combination, a first member and a second member held together in mated position until separated by overcoming a predetermined magnetic force, said first member being constructed and arranged for forceful movement by said body member, and said second member being removably held in a resident position mated with said first member until said forceful movement of said first member whereby said predetermined magnetic force is overcome and said first member is freely moved away from the resident position and allowed to move freely, thereby in combination providing a muscular training system for an athlete, wherein said second member is a pivotable member movably restrained to pivot about a designated resident position; wherein the pivotable member comprises a pivoted rocker arm constructed and arranged to attain two respective bistable restrained positions by coaction of a pair of resident mating device constructed and arranged to releasably retain a respective mating device at one of two stable resident positions, said resident mating devices being carried on opposite rocker arm members on either side or said pivotable member for mating with said rocker arm at said two stable resident positions, and an impact receiving member extending from said rocker arm for contact and movement by said body member to rock the arm between said stable resident positions.

2. The training system of claim 1 wherein said first member is held in a specified place by said second member with magnetic force of a magnitude such that an impact on the first member exceeding a threshold value serves to separate said first member from said second member to permit a degree of movement of the first member away from the specified place, and elastic means exerting a return stroke biasing force on the first member following break away.

3. The training system of claim 2 further comprising a resident framework member wherein said first member is pivoted from the framework member.

4. The training system of claim 2 further comprising a resident framework member, wherein said first member is pivoted about an axis disposed upon said framework member.

* * * * *